US008750776B2

(12) United States Patent
Ogawa et al.

(10) Patent No.: US 8,750,776 B2
(45) Date of Patent: Jun. 10, 2014

(54) FIXING ROLLER, AND FIXING DEVICE AND IMAGE FORMING APPARATUS INCORPORATING SAME

(75) Inventors: Tadashi Ogawa, Tokyo (JP); Takeshi Uchitani, Tokyo (JP); Satoshi Ueno, Tokyo (JP); Takamasa Hase, Kanagawa (JP); Teppei Kawata, Kanagawa (JP); Kazuya Saito, Kanagawa (JP); Shuutaroh Yuasa, Kanagawa (JP); Kensuke Yamaji, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 257 days.

(21) Appl. No.: 13/137,852

(22) Filed: Sep. 19, 2011

(65) Prior Publication Data

US 2012/0093551 A1 Apr. 19, 2012

(30) Foreign Application Priority Data

Oct. 19, 2010 (JP) ..... 2010-234518

(51) Int. Cl.
*G03G 15/20* (2006.01)

(52) U.S. Cl.
USPC ..... 399/333

(58) Field of Classification Search
USPC ..... 399/333, 336
See application file for complete search history.

(56) References Cited

U.S. PATENT DOCUMENTS 6,002,106 A * 12/1999 Kataoka et al. ..... 219/216
7,266,336 B2 9/2007 Ueno et al.
7,272,354 B2 9/2007 Murakami et al.
7,450,872 B2 11/2008 Ueno et al.
7,491,917 B2 2/2009 Ueno
7,509,085 B2 3/2009 Yoshinaga et al.
7,546,049 B2 6/2009 Ehara et al.
7,672,605 B2 3/2010 Kayahara et al.
7,693,439 B2 4/2010 Seo et al.
7,715,774 B2 5/2010 Ueno
7,734,208 B2 6/2010 Seo et al.
7,778,581 B2 8/2010 Seo et al.
7,783,240 B2 8/2010 Ito et al.
7,796,933 B2 9/2010 Ueno et al.
7,801,457 B2 9/2010 Seo et al.

(Continued)

FOREIGN PATENT DOCUMENTS

CN 101105679 A 1/2008
JP 8-129313 A 5/1996

(Continued)

OTHER PUBLICATIONS

Chinese Office Action dated Feb. 7, 2014 for corresponding Chinese Application No. 201110307035.

(Continued)

*Primary Examiner* — Walter L Lindsay, Jr.
*Assistant Examiner* — Rodney Bonnette
(74) *Attorney, Agent, or Firm* — Harness, Dickey & Pierce, P.L.C.

(57) ABSTRACT

A fixing roller includes a fixing sleeve including a heat generating layer; and a support roll inserted into the fixing sleeve to support the fixing sleeve and including a foam layer constituting an outer circumferential surface of the support roll. The foam layer includes recesses exposing pores containing air; and non-recessed portions contiguous to the recesses and adhered to an inner circumferential surface of the fixing sleeve.

9 Claims, 5 Drawing Sheets

(56) References Cited

U.S. PATENT DOCUMENTS

| | | | |
|---|---|---|---|
| 7,817,952 | B2 | 10/2010 | Seo et al. |
| 7,885,590 | B2 | 2/2011 | Seo et al. |
| 7,925,177 | B2 | 4/2011 | Ishii et al. |
| 7,983,582 | B2 | 7/2011 | Hase |
| 8,014,711 | B2 | 9/2011 | Ito et al. |
| 2005/0191098 | A1 | 9/2005 | Ueno et al. |
| 2006/0029411 | A1 | 2/2006 | Ishii et al. |
| 2006/0165443 | A1 | 7/2006 | Yoshinaga et al. |
| 2006/0205578 | A1 | 9/2006 | Ogawa et al. |
| 2006/0216085 | A1 | 9/2006 | Murakami et al. |
| 2006/0289419 | A1 | 12/2006 | Ueno |
| 2007/0014600 | A1 | 1/2007 | Ishii et al. |
| 2007/0059011 | A1 | 3/2007 | Seo et al. |
| 2007/0201916 | A1 | 8/2007 | Ueno |
| 2007/0212089 | A1 | 9/2007 | Seo et al. |
| 2007/0264060 | A1 | 11/2007 | Ueno et al. |
| 2007/0280754 | A1 | 12/2007 | Ogawa et al. |
| 2008/0013996 | A1 * | 1/2008 | Ito ..... 399/333 |
| 2008/0025772 | A1 | 1/2008 | Seo et al. |
| 2008/0025773 | A1 | 1/2008 | Ito et al. |
| 2008/0044196 | A1 | 2/2008 | Seo et al. |
| 2008/0219721 | A1 | 9/2008 | Ito et al. |
| 2008/0226326 | A1 | 9/2008 | Seo et al. |
| 2008/0232873 | A1 | 9/2008 | Ueno et al. |
| 2009/0148205 | A1 | 6/2009 | Seo et al. |
| 2009/0245897 | A1 | 10/2009 | Seo et al. |
| 2009/0297197 | A1 | 12/2009 | Hase |
| 2010/0014903 | A1 | 1/2010 | Seto et al. |
| 2010/0061753 | A1 | 3/2010 | Hase |
| 2010/0158553 | A1 | 6/2010 | Ueno |
| 2010/0232844 | A1 | 9/2010 | Saito et al. |
| 2010/0239292 | A1 | 9/2010 | Fujita et al. |
| 2010/0303521 | A1 | 12/2010 | Ogawa et al. |
| 2011/0026988 | A1 | 2/2011 | Yoshikawa et al. |
| 2011/0044734 | A1 | 2/2011 | Shimokawa et al. |
| 2011/0052237 | A1 | 3/2011 | Yoshikawa et al. |
| 2011/0052277 | A1 | 3/2011 | Ueno et al. |
| 2011/0058862 | A1 | 3/2011 | Yamaguchi et al. |
| 2011/0058863 | A1 | 3/2011 | Shinshi et al. |
| 2011/0064443 | A1 | 3/2011 | Iwaya et al. |
| 2011/0064450 | A1 | 3/2011 | Ishii et al. |
| 2011/0064490 | A1 | 3/2011 | Imada et al. |
| 2011/0064502 | A1 | 3/2011 | Hase et al. |
| 2011/0085832 | A1 | 4/2011 | Hasegawa et al. |
| 2011/0091253 | A1 | 4/2011 | Seo et al. |
| 2011/0116848 | A1 | 5/2011 | Yamaguchi et al. |
| 2011/0129268 | A1 | 6/2011 | Ishii et al. |
| 2011/0150518 | A1 | 6/2011 | Hase et al. |
| 2011/0176821 | A1 | 7/2011 | Hase |
| 2011/0182638 | A1 | 7/2011 | Ishii et al. |
| 2011/0194869 | A1 | 8/2011 | Yoshinaga et al. |
| 2011/0194870 | A1 | 8/2011 | Hase et al. |
| 2011/0200368 | A1 | 8/2011 | Yamaguchi et al. |
| 2011/0200370 | A1 | 8/2011 | Ikebuchi et al. |
| 2011/0206427 | A1 | 8/2011 | Iwaya et al. |
| 2011/0217056 | A1 | 9/2011 | Yoshinaga et al. |
| 2011/0217093 | A1 | 9/2011 | Tokuda et al. |
| 2011/0217095 | A1 | 9/2011 | Ishii et al. |
| 2011/0222875 | A1 | 9/2011 | Imada et al. |
| 2011/0222876 | A1 | 9/2011 | Yuasa et al. |
| 2011/0222888 | A1 | 9/2011 | Ikebuchi et al. |
| 2011/0222926 | A1 | 9/2011 | Ueno et al. |
| 2011/0222929 | A1 | 9/2011 | Fujimoto et al. |
| 2011/0222930 | A1 | 9/2011 | Fujimoto et al. |
| 2011/0222931 | A1 | 9/2011 | Shinshi et al. |
| 2011/0229161 | A1 | 9/2011 | Ueno et al. |
| 2011/0229162 | A1 | 9/2011 | Ogawa et al. |
| 2011/0229178 | A1 | 9/2011 | Ogawa et al. |
| 2011/0229180 | A1 | 9/2011 | Saito |
| 2011/0229181 | A1 | 9/2011 | Iwaya et al. |
| 2011/0229225 | A1 | 9/2011 | Ishii et al. |
| 2011/0229226 | A1 | 9/2011 | Tokuda et al. |
| 2011/0229227 | A1 | 9/2011 | Yoshikawa et al. |
| 2011/0229228 | A1 | 9/2011 | Yoshikawa et al. |
| 2011/0229236 | A1 | 9/2011 | Ehara et al. |
| 2011/0274453 | A1 | 11/2011 | Shimokawa et al. |
| 2011/0311284 | A1 | 12/2011 | Seo et al. |

FOREIGN PATENT DOCUMENTS

| | | | |
|---|---|---|---|
| JP | 2002367766 | A | 12/2002 |
| JP | 2006-285216 | A | 10/2006 |
| JP | 2008009002 | A | 1/2008 |
| JP | 2009251406 | A | 10/2009 |
| JP | 2010044411 | A | 2/2010 |

OTHER PUBLICATIONS

Japanese Office Action dated Apr. 1, 2014 for corresponding Japanese Application No. 2010-234518.

* cited by examiner

FIG. 5
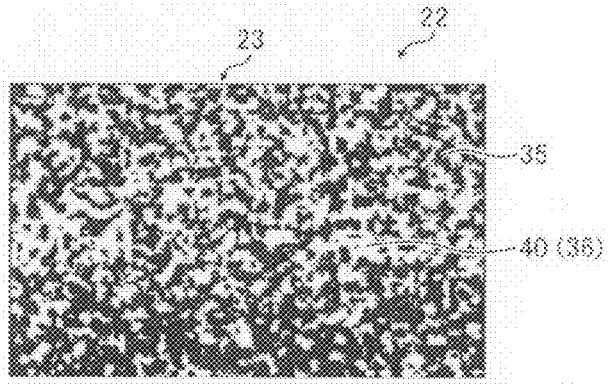
FIG. 6
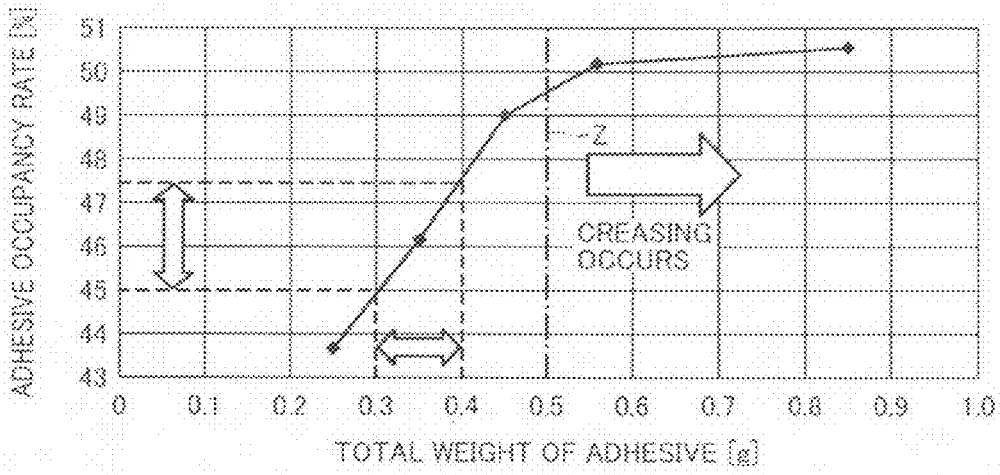
FIG. 7
| TOTAL WEIGHT OF ADHESIVE [g] | ADHESIVE OCCUPANCY RATE [%] | WEIGHT OF APPLIED ADHESIVE PER UNIT AREA [mg/cm$^2$] | CREASING OCCURRENCE RATE [%] |
|---|---|---|---|
| 0.26 | 44.0 | 0.76 | 0.0 |
| 0.27 | 44.2 | 0.79 | 0.0 |
| 0.36 | 46.5 | 1.06 | 0.0 |
| 0.37 | 46.7 | 1.09 | 0.0 |
| 0.47 | 49.3 | 1.38 | 0.0 |
| 0.48 | 49.5 | 1.41 | 11.1 |
| 0.73 | 50.4 | 2.14 | 66.7 |
| 0.75 | 50.5 | 2.20 | 55.6 |
| 0.82 | 50.6 | 2.41 | 88.9 |

FIXING ROLLER, AND FIXING DEVICE AND IMAGE FORMING APPARATUS INCORPORATING SAME

CROSS-REFERENCE TO RELATED APPLICATIONS

This patent application is based on and claims priority pursuant to 35 U.S.C. §119 to Japanese Patent Application No. 2010-234518, filed on Oct. 19, 2010, in the Japan Patent Office, the entire disclosure of which is hereby incorporated herein by reference.

FIELD OF THE INVENTION

Example embodiments generally relate to a fixing roller, a fixing device, and an image forming apparatus, and more particularly, to a fixing roller for heating a recording medium to fix a toner image thereon, and a fixing device and an image forming apparatus including the fixing roller.

BACKGROUND OF THE INVENTION

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to render the electrostatic latent image visible as a toner image; the toner image is directly transferred from the image carrier onto a recording medium or is indirectly transferred from the image carrier onto a recording medium via an intermediate transfer member; a cleaner then collects residual toner not transferred and remaining on the surface of the image carrier after the toner image is transferred from the image carrier onto the recording medium; finally, a fixing device applies heat and pressure to the recording medium bearing the toner image to fix the toner image on the recording medium, thus forming the image on the recording medium.

Such fixing device may include a fixing roller heated by a heater, and a pressing roller pressed against the fixing roller to form a nip therebetween. As a recording medium bearing a toner image passes through the nip, the fixing roller and the pressing roller apply heat and pressure to the recording medium to melt and fix the toner image on the recording medium. Thereafter, the recording medium bearing the fixed toner image is discharged from the nip.

With a configuration in which an induction heater is used as the heater that heats the fixing roller, the fixing roller is constructed of a hollow cylindrical fixing sleeve including a heat generating layer that generates heat by a magnetic flux from the induction heater and a support roll inserted into the fixing sleeve. The support roll includes a foam layer made of silicone rubber foam and constituting the outer circumferential surface of the support roll. As a method of securing the support roll to the fixing sleeve, it is known to apply an adhesive to the entire outer circumferential surface of the support roll that adheres the outer circumferential surface of the support roll to the inner circumferential surface of the fixing sleeve.

However, such configuration of the fixing roller has a drawback in that as the induction heater heats the fixing roller, air trapped between the outer circumferential surface of the support roll and the inner circumferential surface of the fixing sleeve thermally expands and cannot be exhausted from the fixing roller, increasing repulsive load, that is, pressure generated by the pressing roller pressing against the fixing roller, applied at the center of the fixing roller in the axial direction thereof. As a result, the fixing roller with the increased repulsive load may crease the recording medium that contacts the fixing roller as the recording medium passes through the nip formed between the fixing roller and the pressing roller.

Referring to FIG. 1, a detailed description is now given of a mechanism that causes such creasing of the recording medium.

FIG. 1 includes diagram A1 showing arrows F1 that indicate a force applied to the recording medium and arrows F2 that indicate a conveyance speed at which the recording medium is conveyed through the nip at an ambient temperature; graph B1 showing a pressure distribution in the axial direction of the fixing roller of pressure applied by the fixing roller to the recording medium at the nip at the ambient temperature; diagram A2 showing arrows F3 that indicate a force applied to the recording medium and arrows F4 that indicate a conveyance speed at which the recording medium is conveyed through the nip at a fixing temperature at which a toner image is fixed on the recording medium; and graph B2 showing a pressure distribution in the axial direction of the fixing roller of pressure applied by the fixing roller to the recording medium at the nip at the fixing temperature.

Generally, at the ambient temperature as shown in diagram A1, with the pressing roller having a hand drum shape, the lateral ends of the recording medium in the axial direction of the fixing roller are conveyed at a speed higher than a speed at which the center of the recording medium in the axial direction of the fixing roller is conveyed, as shown by the arrows F2 in which the longer arrows show the higher speed and the shorter arrows show the slower speed. Accordingly, a substantially identical pressure is applied by the fixing roller to the recording medium over the axial direction of the fixing roller as shown in diagram B1 and the fixing roller applies the force in the two opposite directions as shown by the arrows F1 to the recording medium, thus stretching the recording medium outward in the axial direction of the fixing roller and therefore preventing creasing of the recording medium.

However, as the induction heater heats the fixing roller, air trapped between the fixing sleeve and the support roll thermally expands, increasing the repulsive load applied to the center of the fixing roller in the axial direction thereof as shown in graph B2. As a result, the recording medium is conveyed at a higher speed at the center of the fixing roller in the axial direction thereof as indicated by the arrows F4 in diagram A2, thus offsetting the force that stretches the recording medium outward in the axial direction of the fixing roller as indicated by the arrows F3 in diagram A2 and therefore creasing the recording medium.

BRIEF SUMMARY OF THE INVENTION

At least one embodiment may provide a fixing roller that includes a fixing sleeve including a heat generating layer; and a support roll inserted into the fixing sleeve to support the fixing sleeve and including a foam layer constituting an outer circumferential surface of the support roll. The foam layer includes recesses exposing pores containing air; and non-recessed portions contiguous to the recesses and adhered to an inner circumferential surface of the fixing sleeve.

At least one embodiment may provide a fixing device that includes the fixing roller described above; a heater disposed opposite the fixing roller to heat the fixing roller; and a pressing rotary body pressed against the fixing roller to form a nip therebetween through which a recording medium bearing a toner image passes. The fixing roller and the pressing rotary body apply heat and pressure to the recording medium to melt and fix the toner image on the recording medium as the recording medium passes through the nip.

At least one embodiment may provide an image forming apparatus that includes the fixing device described above.

Additional features and advantages of example embodiments will be more fully apparent from the following detailed description, the accompanying drawings, and the associated claims.

BRIEF DESCRIPTION OF THE SEVERAL VIEWS OF THE DRAWINGS

A more complete appreciation of example embodiments and the many attendant advantages thereof will be readily obtained as the same becomes better understood by reference to the following detailed description when considered in connection with the accompanying drawings, wherein:

FIG. 5 is a plan view of an insulating layer of a support roll included in the fixing roller shown in FIG. 4;

FIG. 6 is a graph showing a relation between a total weight of an adhesive applied to the insulating layer shown in FIG. 5 and an adhesive occupancy rate on the insulating layer;

FIG. 7 is a lookup table showing a relation between the total weight of the adhesive applied to the insulating layer, the adhesive occupancy rate, a weight of applied adhesive per unit area of the insulating layer, and a creasing occurrence rate of a recording medium;

Figure 1:
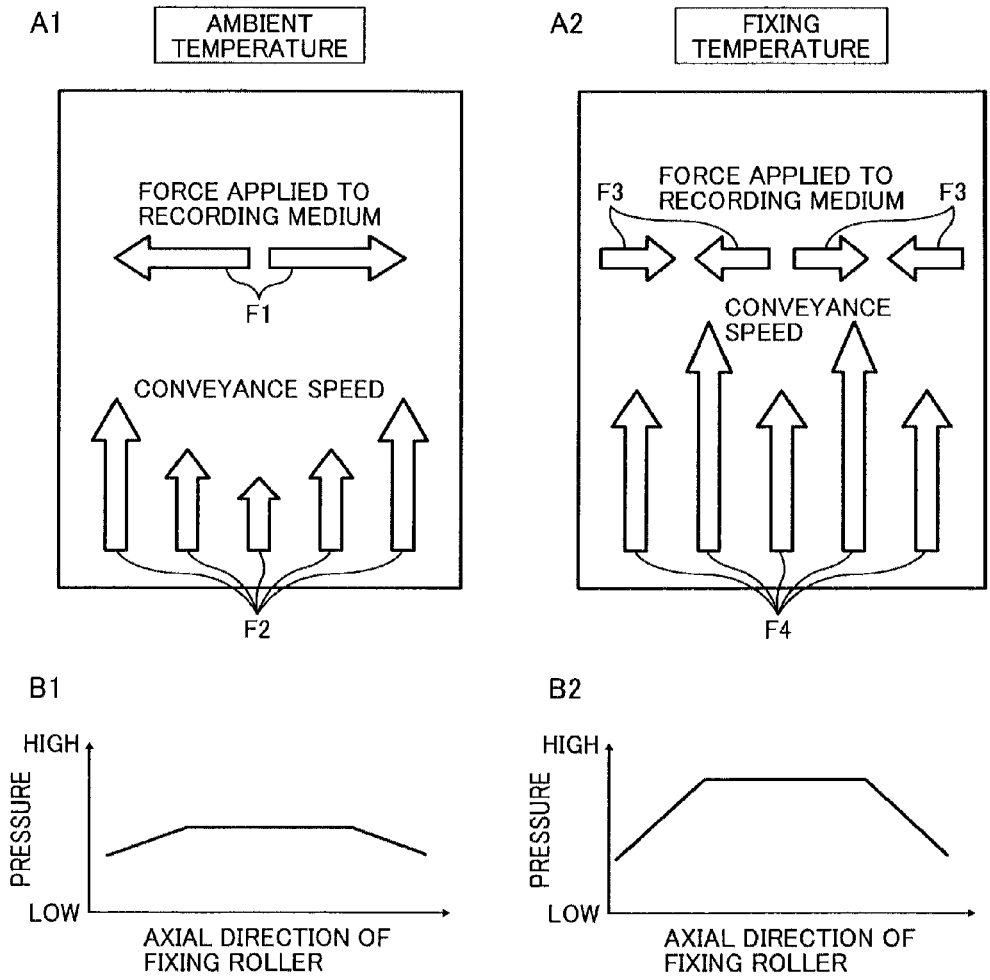
FIG. 1 RELATED ART
FIG. 1 is a diagram showing a related-art mechanism that causes creasing of a recording medium.

The accompanying drawings are intended to depict example embodiments and should not be interpreted to limit the scope thereof. The accompanying drawings are not to be considered as drawn to scale unless explicitly noted.

DETAILED DESCRIPTION OF THE INVENTION

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Figure 2:
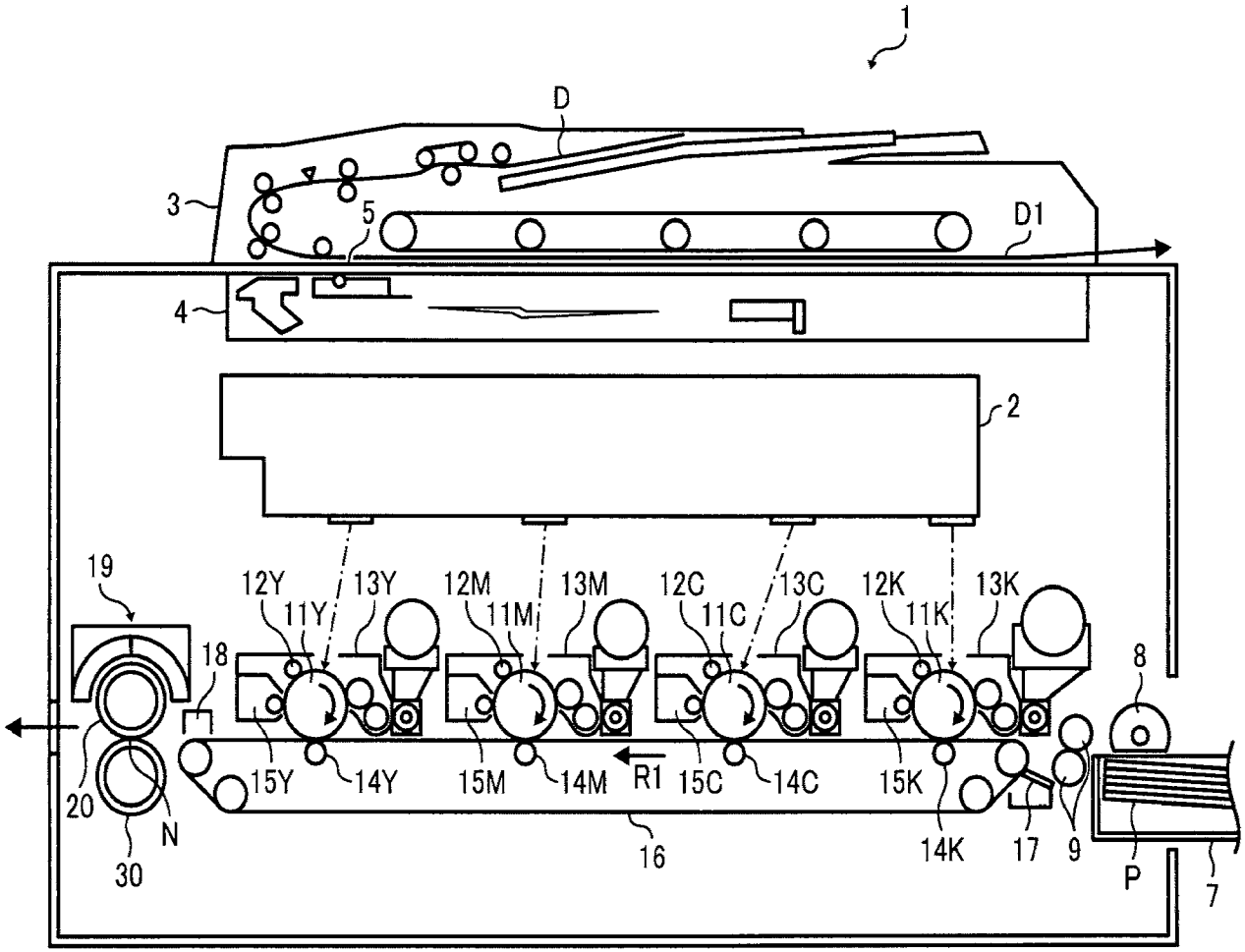
FIG. 2 is a schematic view of an image forming apparatus according to an example embodiment.

Referring now to the drawings, wherein like reference numerals designate identical or corresponding parts throughout the several views, particularly to FIG. 2, an image forming apparatus 1 according to an example embodiment is explained.

FIG. 2 is a schematic view of the image forming apparatus 1. As illustrated in FIG. 2, the image forming apparatus 1 may be a copier, a facsimile machine, a printer, a multifunction printer having at least one of copying, printing, scanning, plotter, and facsimile functions, or the like. According to this example embodiment, the image forming apparatus 1 is a tandem color copier for forming a color image on a recording medium by electrophotography.

Referring to FIG. 2, the following describes the structure of the image forming apparatus 1.

As illustrated in FIG. 2, the image forming apparatus 1 includes an auto document feeder 3 disposed atop the image forming apparatus 1 to feed an original document D to an original document reader 4 disposed below the auto document feeder 3. As the original document D is conveyed over an exposure glass 5 of the original document reader 4, the original document reader 4 reads an image on the original document D and generates image data. Below the original document reader 4 is a writer 2 that emits laser beams onto photoconductive drums 11K, 11C, 11M, and 11Y surrounded by chargers 12K, 12C, 12M, and 12Y, development devices 13K, 13C, 13M, and 13Y, and cleaners 15K, 15C, 15M, and 15Y, respectively. Specifically, the writer 2 emits the laser beams onto the photoconductive drums 11K, 11C, 11M, and 11Y charged by the chargers 12K, 12C, 12M, and 12Y according to the image data sent from the original document reader 4, thus forming electrostatic latent images on the photoconductive drums 11K, 11C, 11M, and 11Y. The development devices 13K, 13C, 13M, and 13Y visualize the electrostatic latent images formed on the photoconductive drums 11K, 11C, 11M, and 11Y with black, cyan, magenta, and yellow toners into black, cyan, magenta, and yellow toner images, respectively. Thus, the photoconductive drums 11K, 11C, 11M, and 11Y serve as image carriers that carry the electrostatic latent images and the resultant toner images. The photoconductive drums 11K, 11C, 11M, and 11Y are disposed opposite transfer bias rollers 14K, 14C, 14M, and 14Y that transfer the black, cyan, magenta, and yellow toner images from the photoconductive drums 11K, 11C, 11M, and 11Y onto a recording medium P conveyed on a transfer belt 16. Specifically, the transfer belt 16, looped over the transfer bias rollers 14K, 14C, 14M, and 14Y and other rollers including a driving roller, rotates in a rotation direction R1. Beside the transfer belt 16 is a paper tray 7 that contains a plurality of recording media P (e.g., transfer sheets). Above the paper tray 7 is a feed roller 8 that picks up and feeds a recording medium P from the paper tray 7 to a registration roller pair 9 that feeds the recording medium P to the transfer belt 16 at a proper time. As the recording medium P is conveyed on the transfer belt 16, the transfer bias rollers 14K, 14C, 14M, and 14Y transfer the black, cyan, magenta, and yellow toner images formed on the photoconductive drums 11K, 11C, 11M, and 11Y onto the recording medium P on the transfer belt 16 in such a manner that the black, cyan, magenta, and yellow toner images are superimposed on the recording medium P, thus producing a color toner image on the recording medium P. After the transfer of the black, cyan, magenta, and yellow toner images, the cleaners 15K, 15C, 15M, and 15Y remove residual toners from the photoconductive drums 11K, 11C, 11M, and 11Y.

The transfer belt 16 is disposed opposite a transfer belt cleaner 17, disposed at one end of the transfer belt 16 in the rotation direction R1 thereof in proximity to the registration roller pair 9, which cleans the transfer belt 16. Conversely, at another end of the transfer belt 16 in the rotation direction R1 thereof is a separation charger 18 that neutralizes charges stored in the recording medium P. Downstream from the separation charger 18 in a conveyance direction of the recording medium P is a fixing device 19 that fixes the color toner image on the recording medium P.

Referring to FIG. 2, the following describes the operation of the image forming apparatus 1 having the above-described structure to form a color toner image on a recording medium P.

Conveyance rollers of the auto document feeder 3 convey an original document D placed on an original document tray in a direction D1 to the exposure glass 5 of the original document reader 4. As the original document D is conveyed over the exposure glass 5, the original document reader 4 optically reads an image on the original document D. For example, a lamp of the original document reader 4 emits a light beam onto the original document D bearing the image. The light beam reflected by the original document D travels to a color sensor through mirrors and a lens, where the image is formed.

The color sensor separates the image into red, green, and blue images and converts the images into electric image signals for red, green, and blue. Based on the respective electric image signals, an image processor of the original document reader 4 performs processing such as color conversion, color correction, and space frequency correction, thus producing black, cyan, magenta, and yellow image data. Thereafter, the black, cyan, magenta, and yellow image data are sent to the writer 2. The writer 2 emits laser beams onto the photoconductive drums 11K, 11C, 11M, and 11Y according to the black, cyan, magenta, and yellow image data sent from the original document reader 4.

A detailed description is now given of five processes performed on the photoconductive drums 11K, 11C, 11M, and 11Y, that is, a charging process, an exposure process, a development process, a transfer process, and a cleaning process.

The four photoconductive drums 11K, 11C, 11M, and 11Y rotate clockwise in FIG. 2. In the charging process, the chargers 12K, 12C, 12M, and 12Y, disposed opposite the photoconductive drums 11K, 11C, 11M, and 11Y, uniformly charge an outer circumferential surface of the respective photoconductive drums 11K, 11C, 11M, and 11Y, thus generating a charging potential on the respective photoconductive drums 11K, 11C, 11M, and 11Y.

In the exposure process, four light sources of the writer 2, disposed opposite the photoconductive drums 11K, 11C, 11M, and 11Y, emit laser beams according to the black, cyan, magenta, and yellow image data, respectively. The laser beams corresponding to the black, cyan, magenta, and yellow image data travel through different optical paths, respectively.

For example, the laser beam corresponding to the yellow image data irradiates the leftmost photoconductive drum 11Y in FIG. 2. Specifically, a polygon mirror of the writer 2, which rotates at a high speed, causes the laser beam corresponding to the yellow image data to scan the charged surface of the photoconductive drum 11Y in an axial direction of the photoconductive drum 11Y, that is, a main scanning direction. Thus, an electrostatic latent image is formed on the surface of the photoconductive drum 11Y charged by the charger 12Y according to the yellow image data.

Similarly, the laser beam corresponding to the magenta image data irradiates the second photoconductive drum 11M from the left in FIG. 2, forming an electrostatic latent image according to the magenta image data. The laser beam corresponding to the cyan image data irradiates the third photoconductive drum 11C from the left in FIG. 2, forming an electrostatic latent image according to the cyan image data. The laser beam corresponding to the black image data irradiates the rightmost photoconductive drum 11K in FIG. 2, forming an electrostatic latent image according to the black image data.

In the development process, the development devices 13K, 13C, 13M, and 13Y, disposed opposite the photoconductive drums 11K, 11C, 11M, and 11Y, supply black, cyan, magenta, and yellow toners to the electrostatic latent images formed on the photoconductive drums 11K, 11C, 11M, and 11Y, respectively, thus making the electrostatic latent images visible as black, cyan, magenta, and yellow toner images.

In the transfer process, the transfer bias rollers 14K, 14C, 14M, and 14Y transfer the black, cyan, magenta, and yellow toner images formed on the photoconductive drums 11K, 11C, 11M, and 11Y, respectively, onto a recording medium P conveyed on the transfer belt 16. The transfer bias rollers 14K, 14C, 14M, and 14Y are disposed opposite the photoconductive drums 11K, 11C, 11M, and 11Y via the transfer belt 16 in a state in which the transfer bias rollers 14K, 14C, 14M, and 14Y contact an inner circumferential surface of the transfer belt 16. As the recording medium P conveyed on the transfer belt 16 contacts the photoconductive drums 11K, 11C, 11M, and 11Y, the transfer bias rollers 14K, 14C, 14M, and 14Y transfer the black, cyan, magenta, and yellow toner images from the photoconductive drums 11K, 11C, 11M, and 11Y onto the recording medium P successively in such a manner that the black, cyan, magenta, and yellow toner images are superimposed on the same position on the recording medium P, thus producing a color toner image on the recording medium P.

In the cleaning process, the cleaners 15K, 15C, 15M, and 15Y, disposed opposite the photoconductive drums 11K, 11C, 11M, and 11Y, collect residual toners not transferred and therefore remaining on the photoconductive drums 11K, 11C, 11M, and 11Y from the photoconductive drums 11K, 11C, 11M, and 11Y, respectively.

Thereafter, dischargers, disposed opposite the photoconductive drums 11K, 11C, 11M, and 11Y, discharge the surface of the respective photoconductive drums 11K, 11C, 11M, and 11Y, thus completing a series of processes performed on the photoconductive drums 11K, 11C, 11M, and 11Y. As the recording medium P bearing the color toner image passes through the separation charger 18, the separation charger 18 neutralizes the potential stored in the recording medium P, separating the recording medium P from the transfer belt 16 without generating toner dust.

The transfer belt cleaner 17, disposed opposite the transfer belt 16, collects foreign substances adhered to the transfer belt 16 therefrom. A recording medium P to be conveyed on the transfer belt 16 is supplied from the paper tray 7 via the registration roller pair 9. Specifically, a recording medium P picked up and fed by the feed roller 8 passes through a conveyance guide and reaches the registration roller pair 9. When the recording medium P contacts the registration roller pair 9, the registration roller pair 9 stops the recording medium P temporarily, and then feeds the recording medium P to the transfer belt 16 at a proper time for transferring the black, cyan, magenta, and yellow toner images from the photoconductive drums 11K, 11C, 11M, and 11Y onto the recording medium P.

After being separated from the transfer belt 16, the recording medium P bearing the color toner image is sent to the fixing device 19. As the recording medium P passes through the fixing device 19 where a pressing roller 30 is pressed against a fixing roller 20 to form a nip N therebetween, the fixing roller 20 and the pressing roller 30 apply heat and pressure to the recording medium P, thus fixing the color toner image on the recording medium P. Thereafter, an output roller pair disposed downstream from the fixing device 19 in the conveyance direction of the recording medium P discharges the recording medium P bearing the fixed color toner image to an outside of the image forming apparatus 1, thus completing a series of processes for forming the color toner image on the recording medium P.

Figure 3:
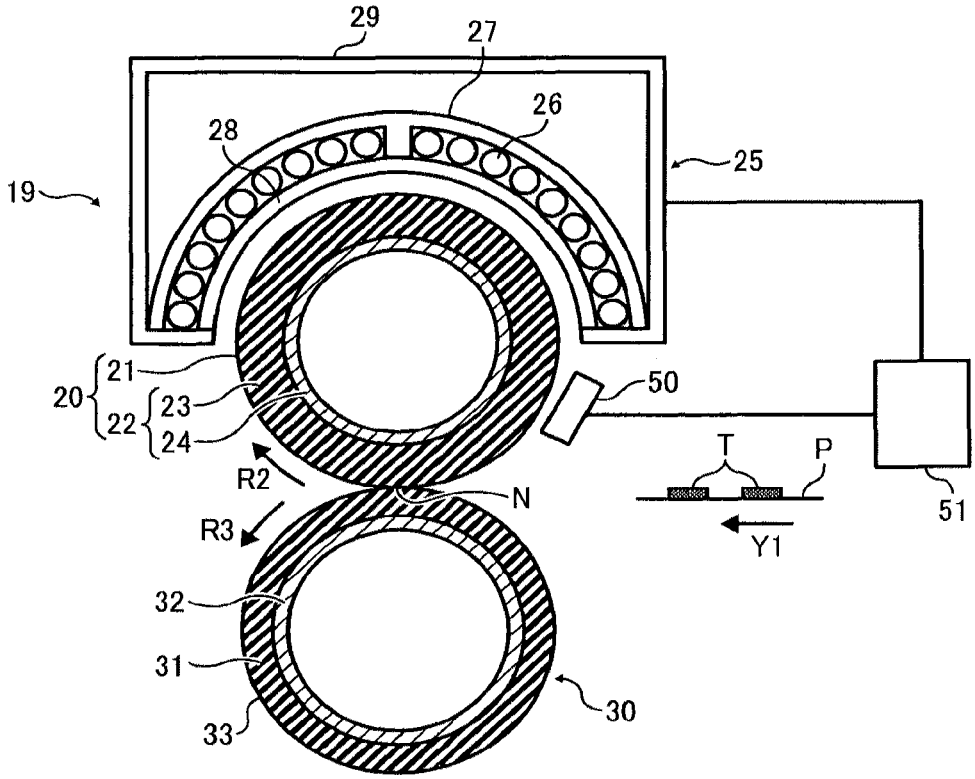
FIG. 3 is a schematic vertical sectional view of a fixing device included in the image forming apparatus shown in FIG. 2.
Figure 4:
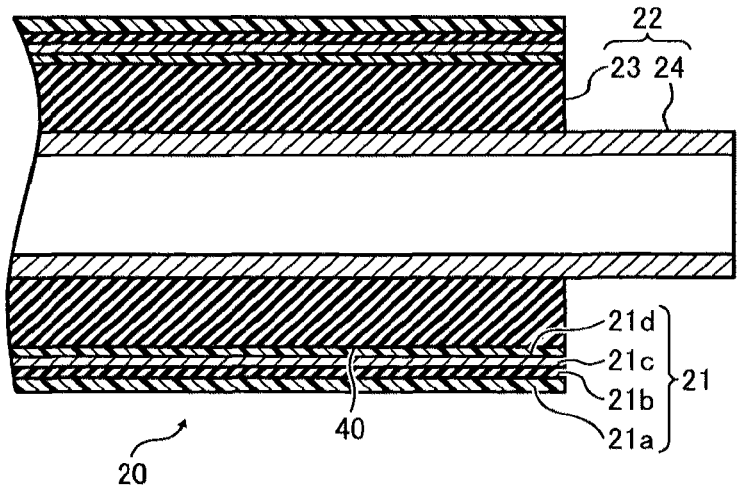
FIG. 4 is a partial horizontal sectional view of a fixing roller included in the fixing device shown in FIG. 3.

Referring to FIGS. 3 and 4, the following describes the structure and operation of the fixing device 19 installed in the image forming apparatus 1 described above.

FIG. 3 is a vertical sectional view of the fixing device 19. FIG. 4 is a partially horizontal sectional view of the fixing roller 20 of the fixing device 19. It is to be noted that FIG. 4 illustrates one end of the fixing roller 20 in an axial direction, that is, a width direction, thereof, and another end of the fixing roller 20, which has the similar structure, is omitted.

As illustrated in FIG. 3, the fixing device 19 (e.g., a fuser unit) includes an induction heater 25 disposed opposite the fixing roller 20 and serving as a heater or a magnetic flux generator that heats the fixing roller 20; and the pressing roller 30 serving as a pressing rotary body pressed against the fixing roller 20. The fixing roller 20 includes a fixing sleeve 21 and a support roll 22.

As illustrated in FIG. 4, the fixing sleeve 21 is constructed of four layers: a base layer 21*d* constituting an inner circumferential surface of the fixing sleeve 21; a heat generating layer 21*c* disposed on the base layer 21*d*; an elastic layer 21*b* disposed on the heat generating layer 21*c*; and a release layer 21*a* disposed on the elastic layer 21*b*. The base layer 21*d*, having a thickness in a range of from about 30 micrometers to about 100 micrometers, is made of resin such as polyimide. The heat generating layer 21*c*, having a thickness in a range of from about 5 micrometers to about 20 micrometers, is made of a conductor such as copper, silver, or aluminum. The heat generating layer 21*c* is plated with the base layer 21*d*. As a magnetic flux generated by the induction heater 25 reaches the heat generating layer 21*c* of the fixing sleeve 21, the heat generating layer 21*c* is heated by the magnetic flux by electromagnetic induction. Thus, the fixing sleeve 21 heats itself effectively by electromagnetic induction.

The elastic layer 21*b*, having a thickness in a range of from about 30 micrometers to about 200 micrometers, is made of silicone rubber. The elastic layer 21*b* minimizes faulty fixing caused by variation in heat and pressure applied at the nip N formed between the fixing roller 20 and the pressing roller 30, especially when the fixing device 19 fixes a color toner image on a recording medium P. The release layer 21*a*, having a thickness in a range of from about 20 micrometers to about 50 micrometers, is made of fluorine compound such as tetrafluoroethylene-perfluoroalkylvinylether copolymer (PFA). The release layer 21*a* may be a tube that facilitates separation of toner of a toner image T on a recording medium P from the fixing sleeve 21.

According to this example embodiment, the base layer 21*d* constitutes the inner circumferential surface of the fixing sleeve 21. Alternatively, the base layer 21*d* may be omitted so that the heat generating layer 21*c* constitutes the inner circumferential surface of the fixing sleeve 21. For example, the heat generating layer 21*c* is made of magnetic metal such as iron, cobalt, nickel, or an alloy of these or non-magnetic metal such as SUS 304 or SUS 316 stainless steel. Further, the heat generating layer 21*c* may be constructed of two layers: a first non-magnetic layer and a second non-magnetic layer having a volume resistivity different from each other. With the heat generating layer 21*c* made of the magnetic metal or the non-magnetic metal described above, the base layer 21*d* may include a nickel layer that enhances resistance to rust.

The support roll 22 is constructed of a metal core 24 made of stainless steel and a heat resistant insulating layer 23 disposed on the metal core 24. The insulating layer 23 of the support roll 22, with a thickness in a range of from about 2 mm to about 10 mm, has an Asker hardness (Hardness spring) in a range of from about 15 degrees to about 50 degrees. According to this example embodiment, the insulating layer 23 is made of silicone rubber foam. Accordingly, even when an outer diameter of the support roll 22 becomes greater than an inner diameter of the fixing sleeve 21 due to thermal expansion, the support roll 22 exerts minimized stress to the fixing sleeve 21. The support roll 22 inserted into the fixing sleeve 21 is adhered to the fixing sleeve 21 with a silicone adhesive 40, a detailed description of which is deferred.

As shown in FIG. 3, a thermistor 50 disposed opposite an outer circumferential surface of the fixing sleeve 21 detects a temperature, that is, a fixing temperature, of the fixing sleeve 21. For example, the thermistor 50 is a thermal-responsive temperature-sensitive element. The thermistor 50 is operatively connected to a controller 51, that is, a central processing unit (CPU) provided with a random-access memory (RAM) and a read-only memory (ROM), for example. The controller 51 controls the induction heater 25 to adjust an amount of the magnetic flux generated by the induction heater 25 that heats the fixing roller 20 according to a detection result sent from the thermistor 50.

As shown in FIG. 3, the pressing roller 30 is constructed of three layers: a cylindrical core 32 made of aluminum or copper; an elastic layer 31 disposed on the core 32 and made of silicone rubber; and a release layer 33 disposed on the elastic layer 31 and made of PFA. The elastic layer 31 has a thickness in a range of from about 1 mm to about 5 mm. The release layer 33 has a thickness in a range of from about 20 micrometers to about 50 micrometers. With the above-described structure, the pressing roller 30 is pressed against the fixing roller 20 to form the nip N therebetween through which the recording medium P bearing the toner image T passes.

According to this example embodiment, the pressing roller 30 serving as a pressing rotary body is pressed against the fixing roller 20 serving as a fixing rotary body, forming the nip N therebetween. However, the pressing rotary body is not limited to the roller. For example, the pressing rotary body may be an endless belt pressed by a roller or a pad disposed inside a loop formed by the endless belt against the fixing rotary body. Further, the pressing rotary body may not be pressed against the fixing rotary body. For example, the pressing rotary body may merely contact the fixing rotary body.

The induction heater 25 serving as a magnetic flux generator includes a coil 26 (e.g., an exciting coil), a core 27 (e.g., an exciting coil core), a coil guide 28, and a cover 29. The coil 26 includes litz wire made of bundled thin wire wound around the coil guide 28 that covers a part of the outer circumferential surface of the fixing sleeve 21 and extending in the axial direction of the fixing roller 20. The coil guide 28, made of heat resistant resin, is disposed opposite the fixing sleeve 21 to support the coil 26.

The core 27 is made of a ferromagnet (e.g., ferrite) having a relative magnetic permeability of about 2,500 H/m. The core 27 includes a center core and side cores to generate magnetic fluxes toward the heat generating layer 21*c* of the fixing sleeve 21 effectively. The core 27 is disposed opposite the coil 26 extending in the axial direction of the fixing roller 20. The cover 29 covers or houses the coil 26, the core 27, and the coil guide 28. Optionally, an internal core made of a ferromagnet (e.g., ferrite) may be disposed inside the fixing roller 20 and a magnetic flux shield may cover a part of an outer circumferential surface of the internal core.

Referring to FIGS. 3 and 4, the following describes the operation of the fixing device 19 having the above-described structure, that is, a fixing process performed by the fixing device 19. A driver (e.g., a motor) drives and rotates the fixing roller 20 clockwise in FIG. 3 in a rotation direction R2. The rotating fixing roller 20 rotates the pressing roller 30 counterclockwise in FIG. 3 in a rotation direction R3 counter to the rotation direction R2 of the fixing roller 20. The induction heater 25 disposed opposite the fixing sleeve 21 of the fixing roller 20 generates a magnetic flux to heat the fixing sleeve 21. For example, a frequency variable power supply of an oscillator circuit sends a high frequency alternating current in a range of from about 10 kHz to about 1 MHz, preferably in a range of from about 20 kHz to about 800 kHz, to the coil 26. Accordingly, the coil 26 generates magnetic lines of force alternately switched bidirectionally toward the heat generating layer 21*c* of the fixing sleeve 21, thus generating an alternating magnetic field.

The alternating magnetic field generates an eddy current in the heat generating layer 21*c* of the fixing sleeve 21, which causes the heat generating layer 21*c* to generate Joule heat by its electric resistance. Thus, the fixing sleeve 21 heats itself by induction heating of the heat generating layer 21*c* thereof. Thereafter, as the fixing roller 20 rotates, a portion of the outer circumferential surface of the fixing sleeve 21 heated by the induction heater 25 reaches the nip N formed between the fixing roller 20 and the pressing roller 30. The recording medium P bearing the toner image T formed by the image forming processes described above is conveyed in a direction Y1 and enters the nip N while being guided by a guide.

As the recording medium P bearing the toner image T passes through the nip N, the heated portion of the fixing sleeve 21 heats the recording medium P and at the same time the pressing roller 30 applies pressure to the recording medium P, thus melting and fixing the toner image T on the recording medium P. After the recording medium P bearing the fixed toner image T is discharged from the nip N, the heated portion of the fixing sleeve 21 having passed through the nip N and now cooled by the recording medium P returns to an opposed position where the fixing sleeve 21 is disposed opposite the induction heater 25. Thus, a series of the above-described operations is repeated, completing the fixing process constituting a part of the image forming processes.

Referring to FIGS. 3 and 4, the following describes the structure and operation of the fixing roller 20 installed in the fixing device 19 described above. As shown in FIG. 4, the fixing sleeve 21 is adhered to the support roll 22 with the adhesive 40. For example, the adhesive 40 is applied over an entire outer circumferential surface of the support roll 22 in the axial direction of the fixing roller 20. Thus, the inner circumferential surface of the fixing sleeve 21 is adhered to the outer circumferential surface of the support roll 22 with the adhesive 40.

Since the support roll 22 has the insulating layer 23, that is, a foam layer made of silicone rubber foam, which constitutes the outer circumferential surface of the support roll 22, the outer circumferential surface of the support roll 22 has both recesses and non-recessed portions other than the recesses, with the recesses exposing pores containing air. According to this example embodiment, the adhesive 40 is applied solely to the non-recessed portions of the insulating layer 23 of the support roll 22. It is to be noted that pores of the silicone rubber foam used in the insulating layer 23 have a diameter in a range of from about 50 micrometers to about 500 micrometers.

FIG. 5 is a plan view of the outer circumferential surface of the insulating layer 23 of the support roll 22 applied with the adhesive 40. As illustrated in FIG. 5, the insulating layer 23 includes solidly shaded recesses 35 exposing pores and not applied with the adhesive 40 and blank non-recessed portions 36 applied with the adhesive 40. The recesses 35 and the non-recessed portions 36 together form a dappled surface. As a method of applying the adhesive 40 solely to the non-recessed portions 36, an application roller with the adhesive 40 uniformly applied on its outer circumferential surface to produce a thin adhesive layer thereon may contact the rotating support roll 22.

When the support roll 22 is adhered to the fixing sleeve 21 with the adhesive 40 applied solely to the non-recessed portions 36 of the insulating layer 23, a slight gap may be generated between the inner circumferential surface of the fixing sleeve 21 and the outer circumferential surface of the support roll 22 due to the thickness of the adhesive 40. The gap is in communication with lateral ends of the support roll 22, that is, lateral ends of the fixing roller 20 in the axial direction thereof, thus functioning as a vent through which air contained in the foam of the insulating layer 23 may escape from the lateral ends of the fixing roller 20 in the axial direction thereof to an outside of the fixing roller 20. Accordingly, even when air in the foam of the insulating layer 23 thermally expands as the induction heater 25 heats the fixing roller 20, the expanded air escapes to the outside of the fixing roller 20 through the gap between the fixing sleeve 21 and the support roll 22 where the adhesive 40 is not applied. Consequently, the thermally expanded air trapped between the fixing sleeve 21 and the support roll 22 does not increase repulsive load, that is, pressure applied between the pressing roller 30 and the fixing roller 20, at a center of the fixing roller 20 in the axial direction thereof, thus preventing the recording medium P from creasing as the recording medium P passes through the nip N.

It is to be noted that the insulating layer 23 includes closed cell foam that contains pores not connected to each other. Accordingly, air escapes mainly from pores disposed in proximity to the outer circumferential surface of the support roll 22 to the outside of the fixing roller 20 through the gap between the fixing sleeve 21 and the support roll 22 produced at the recesses 35.

Alternatively, the above-described configuration according this example embodiment is also applicable to a configuration of the insulating layer 23 with a mixture of open cell foam containing pores that are connected to each other and closed cell foam not having interconnected pores. With this configuration also, air can escape from the pores of the open cell foam and the closed cell foam disposed on the outer circumferential surface of the support roll 22.

It is to be noted that if the insulating layer 23 has only the open cell foam, it is possible to exhaust air of the insulating layer 23 from the lateral ends of the fixing roller 20 in the axial direction thereof even without the above-described configuration according to this example embodiment. Thus, it is preferable to apply the above-described configuration according to this example embodiment to a configuration in which a fixing roller includes an insulating layer having at least closed cell foam and therefore air contained in pores of the closed cell foam cannot be exhausted from lateral ends of the fixing roller in an axial direction thereof.

Referring to FIGS. 6 to 9, the following describes experiments that examine a relation between an amount (e.g., area and weight) of the adhesive 40 applied to the support roll 22 and an occurrence of creasing of the recording medium P.

The experiments were performed with the image forming apparatus 1 with the fixing roller 20 depicted in FIG. 2 installed therein, using RICOH MY PAPER brand of A3 size sheets. A toner image is printed on one side of a sheet per print job under a standard environment of a temperature of 23 degrees centigrade and a humidity of 50 percent until a toner image is printed on 30 sheets in total. Results of the experiments are shown in FIGS. 6 to 9.

FIG. 6 is a graph showing a relation between a total weight of the adhesive 40 applied to the insulating layer 23 of the support roll 22 (hereinafter referred to as the total weight of adhesive) and a rate of an area to which the adhesive 40 is applied relative to an entire outer circumferential surface area of the insulating layer 23 (hereinafter referred to as the adhesive occupancy rate).

As shown in FIG. 6, as the adhesive occupancy rate increases, the total weight of adhesive also increases. A vertical broken line Z in FIG. 6 defines a border beyond which creasing of the sheet may occur. For example, when the total weight of adhesive is 0.5 g or more, that is, when the total weight of adhesive exceeds the border Z, creasing of the sheet may occur. According to the above-described example embodiment, the adhesive 40 having a total weight in a range of from 0.3 g to 0.4 g is applied to the outer circumferential surface of the support roll 22 including the insulating layer 23 having an outer diameter of 35 mm and an outer circumferential surface area of 340.59 $cm^2$, thus preventing the sheet from creasing.

FIG. 7 is a lookup table showing a relation between the total weight of adhesive, the adhesive occupancy rate, a weight of the adhesive 40 applied to the insulating layer 23 of the support roll 22 per unit area of the insulating layer 23 (hereinafter referred to as the weight of applied adhesive per unit area), and a rate of occurrence of creasing of the sheet (hereinafter referred to as the creasing occurrence rate).

The weight of applied adhesive per unit area is calculated by dividing the total weight of adhesive by the outer circumferential surface area of the insulating layer 23 of 340.59 $cm^2$.

Figure 8:
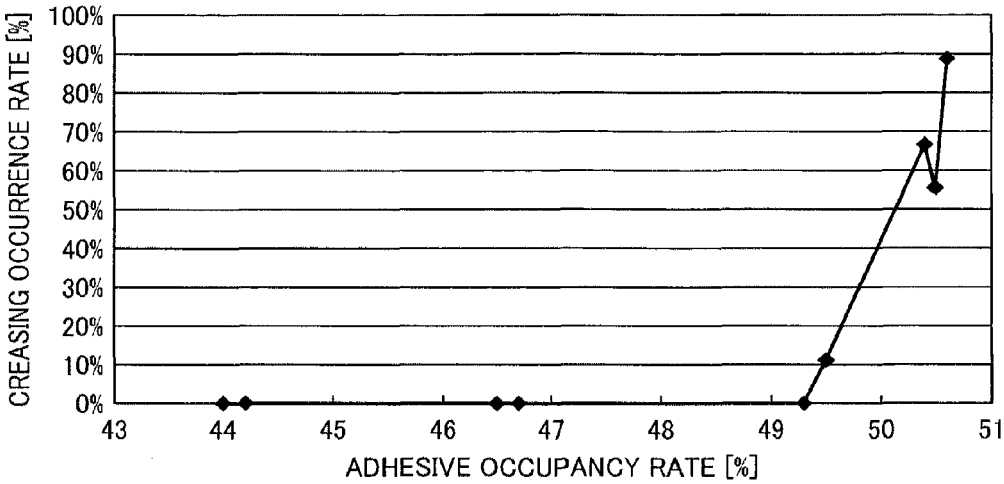
FIG. 8 is a graph showing a relation between the adhesive occupancy rate and the creasing occurrence rate shown in FIG. 7.

FIG. 8 is a graph showing a relation between the adhesive occupancy rate and the creasing occurrence rate shown in FIG. 7.

As shown in FIG. 8, when the adhesive occupancy rate is 49.3 percent or smaller, creasing of the sheet does not occur. By contrast, when the adhesive occupancy rate exceeds 49.3 percent, creasing of the sheet does occur. Accordingly, it is necessary to decrease the adhesive occupancy rate to 49.3 percent or smaller to prevent the sheet from creasing. However, if the amount of the adhesive 40 applied to the insulating layer 23 is too small, the fixing sleeve 21 may separate from or peel off the support roll 22.

To address this problem, it is preferable to set the lower limit of the adhesive occupancy rate of 42.0 percent and the target adhesive occupancy rate in a range of from 42.0 percent to 49.3 percent, thus attaining a desired adhesive strength.

Figure 9:
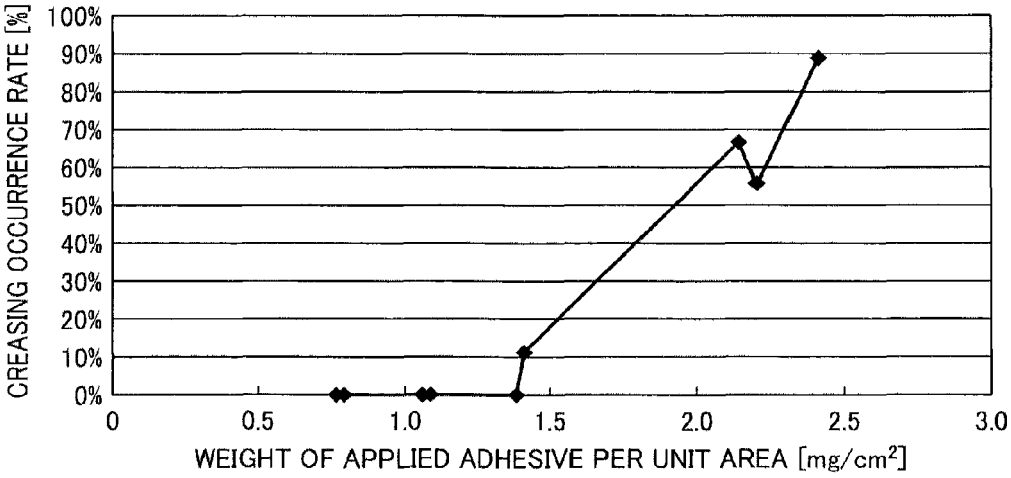
FIG. 9 is a graph showing a relation between the weight of applied adhesive per unit area of the insulating layer and the creasing occurrence rate shown in FIG. 7.

In addition, FIG. 9 is a graph showing a relation between the weight of applied adhesive per unit area and the creasing occurrence rate shown in FIG. 7.

As shown in FIG. 9, when the weight of applied adhesive per unit area is 1.38 $mg/cm^2$ or smaller, creasing of the sheet does not occur. By contrast, when the weight of applied adhesive per unit area exceeds 1.38 $mg/cm^2$, the sheet does crease. Accordingly, it is necessary to set the weight of applied adhesive per unit area to 1.38 $mg/cm^2$ or smaller, thus preventing the sheet from creasing.

The above-described results of the experiments show that the fixing roller 20 having the adhesive occupancy rate of 49.3 percent or smaller and the weight of applied adhesive per unit area of 1.38 $mg/cm^2$ can prevent the recording medium P passing through the nip N from creasing.

The present invention is not limited to the details of example embodiments described above, and various modifications and improvements are possible. For example, according to the above-described example embodiments, the insulating layer 23 of the support roll 22 is made of silicone rubber foam. Alternatively, the insulating layer 23 may be made of silicone rubber microfoam having a pore diameter in a range of from about 20 micrometers to about 50 micrometers or other material. Further, the image forming apparatus 1 installed with the fixing device 19 that uses the fixing roller 20 is not limited to the tandem color copier shown in FIG. 2. For example, the image forming apparatus 1 may be other type of a copier, a printer, a facsimile machine, or a multifunction printer having at least one of copying, printing, scanning, plotter, and facsimile functions.

Referring to FIGS. 2 to 5, the following describes the advantages of the fixing device 19 according to the above-described example embodiments. As shown in FIG. 3, the fixing roller 20 includes the fixing sleeve 21 that includes the heat generating layer 21*c* heated by the heater (e.g., the induction heater 25) to melt and fix the toner image T on the recording medium P; and the support roll 22 inserted into the fixing sleeve 21 to support the fixing sleeve 21 and including the insulating layer 23 (e.g., a foam layer) constituting the outer circumferential surface of the support roll 22. As shown in FIG. 5, the insulating layer 23 includes the recesses 35, constituting an outer circumferential surface of the insulating layer 23, that expose pores containing air; and the non-recessed portions 36, constituting the outer circumferential surface of the insulating layer 23, disposed contiguous to the recesses 35. The non-recessed portions 36 of the insulating layer 23 are adhered to the inner circumferential surface of the fixing sleeve 21.

With this configuration, even if air trapped between the fixing sleeve 21 and the support roll 22 thermally expands as the fixing roller 20 is heated by the induction heater 25, the thermally expanded air escapes from the lateral ends of the support roll 22, that is, the lateral ends of the fixing roller 20 in the axial direction thereof, to the outside of the fixing roller 20 through the recesses 35 where the fixing sleeve 21 is not adhered to the support roll 22 with the adhesive 40. Accordingly, there is no thermally expanded air trapped between the fixing sleeve 21 and the support roll 22 which may increase the repulsive load at the center of the fixing roller 20 in the axial direction thereof, preventing creasing of the recording medium P and thus fixing the toner image T on the recording medium P precisely to produce the high-quality toner image T on the recording medium P.

The non-recessed portions 36 of the insulating layer 23 of the support roll 22 other than the recesses 35 exposing the pores containing air are applied with the adhesive 40.

Accordingly, the thickness of the adhesive 40 applied on the non-recessed portions 36 creates the slight gap between the inner circumferential surface of the fixing sleeve 21 and the outer circumferential surface of the support roll 22. Thus, the thermally expanded air trapped between the fixing sleeve 21 and the support roll 22 escapes from the lateral ends of the fixing roller 20 in the axial direction thereof to the outside of the fixing roller 20 through the slight gap.

The adhesive occupancy rate of the area of the non-recessed portions 36 applied with the adhesive 40 relative to the entire outer circumferential surface area of the insulating layer 23 is 49.3 percent or smaller, and the weight of the adhesive 40 applied to the insulating layer 23 per unit area, that is, the weight of applied adhesive per unit area, is 1.38 $mg/cm^2$ or smaller.

The adhesive occupancy rate and the weight of applied adhesive per unit area set in the above-described ranges prevent creasing of the recording medium P.

The insulating layer 23 includes closed cell foam not having interconnected pores.

Usually, with the fixing roller 20 including the closed cell foam, air contained in the pores may not be exhausted from the lateral ends of the fixing roller 20 in the axial direction thereof to the outside of the fixing roller 20. To address this problem, according to the above-described example embodiments, the fixing roller 20 includes the support roll 22 that includes the insulating layer 23, that is, the foam layer, having the recesses 35 and the non-recessed portions 36 which create the gap between the support roll 22 and the fixing sleeve 21 when the non-recessed portions 36 are applied with the adhesive 40. Accordingly, air contained in the pores of the closed cell foam of the insulating layer 23, when it thermally expands, escapes to the outside of the fixing roller 20 through the gap, thus minimizing localized increase of pressure applied between the fixing roller 20 and the pressing roller 30 and therefore preventing creasing of the recording medium P.

The fixing roller 20 according to the above-described example embodiments is installable in the fixing device 19 where the pressing roller 30, serving as a pressing rotary body, is pressed against the fixing roller 20, serving as a fixing rotary body, heated by the induction heater 25 serving as a heater, forming the nip N between the fixing roller 20 and the pressing roller 30. As the recording medium P passes through the nip N, the fixing roller 20 and the pressing roller 30 apply heat and pressure to the recording medium P to melt and fix the toner image T on the recording medium P.

With the fixing roller 20 according to the above-described example embodiments, thermally expanded air escapes from the lateral ends of the fixing roller 20 in the axial direction thereof to the outside of the fixing roller 20. Accordingly, there is no thermally expanded air trapped between the fixing sleeve 21 and the support roll 22 which may increase the repulsive load at the center of the fixing roller 20 in the axial direction thereof, preventing the recording medium P passing through the nip N from creasing.

The induction heater 25 is used as the heater to cause the fixing sleeve 21 to heat itself, improving energy efficiency. The image forming apparatus 1 installed with the fixing device 19 prevents creasing of the recording medium P, producing the high-quality toner image T on the recording medium P.

As described above, the simple configuration of applying the adhesive 40 to the non-recessed portions 36 of the insulating layer 23 of the support roll 22 attains the above-described advantages of the fixing device 19. Further, an existing foam roller can be modified into the support roll 22 easily, minimizing manufacturing costs.

The present invention has been described above with reference to specific example embodiments. Nonetheless, the present invention is not limited to the details of example embodiments described above, but various modifications and improvements are possible without departing from the spirit and scope of the present invention. It is therefore to be understood that within the scope of the associated claims, the present invention may be practiced otherwise than as specifically described herein. For example, elements and/or features of different illustrative example embodiments may be combined with each other and/or substituted for each other within the scope of the present invention.

What is claimed is:

1. A fixing roller comprising:

a fixing sleeve including a heat generating layer; and a support roll inserted into the fixing sleeve to support the fixing sleeve and including a foam layer constituting an outer circumferential surface of the support roll, the foam layer including:

recesses exposing pores containing air, the recesses are not adhered to an inner circumferential of the fixing sleeve; and non-recessed portions contiguous to the recesses and adhered to the inner circumferential surface of the fixing sleeve.

2. The fixing roller according to claim 1, further comprising an adhesive applied to the non-recessed portions of the foam layer of the support roll.

3. The fixing roller according to claim 2, wherein an adhesive occupancy rate of an area of the non-recessed portions occupied by the adhesive relative to an entire outer circumferential surface area of the foam layer is 49.3 percent or smaller, and a weight of the adhesive applied to the foam layer per unit area is 1.38 $mg/cm^2$ or smaller.

4. The fixing roller according to claim 1, wherein the foam layer includes closed cell foam.

5. A fixing device comprising:

the fixing roller according to claim 1;

a heater disposed opposite the fixing roller to heat the fixing roller; and a pressing rotary body pressed against the fixing roller to form a nip therebetween through which a recording medium bearing a toner image passes, the fixing roller and the pressing rotary body applying heat and pressure to the recording medium to melt and fix the toner image on the recording medium as the recording medium passes through the nip.

6. The fixing device according to claim 5, wherein the heater includes an induction heater.

7. An image forming apparatus comprising the fixing device according to claim 5.

8. The fixing roller according to claim 1, wherein the non-recessed portions of the foam layer of the support roll is adhered to the inner circumferential surface of the fixing sleeve with an adhesive having a thickness that creates a gap between the inner circumferential surface of the fixing sleeve and the outer circumferential surface of the support roll.

9. The fixing roller according to claim 8, wherein the gap between the inner circumferential surface of the fixing sleeve and the outer circumferential surface of the support roll is in communication with lateral ends of the support roll in an axial direction thereof.

* * * * *